US009846446B2

(12) United States Patent
Choi et al.

(10) Patent No.: US 9,846,446 B2
(45) Date of Patent: Dec. 19, 2017

(54) APPARATUS FOR COMPENSATING FOR TEMPERATURE AND METHOD THEREFOR

(71) Applicants: Jae-Won Choi, Gyeonggi-do (KR); Jong-Soo Lee, Gyeonggi-do (KR); Dae-Hyun Kwon, Seoul (KR); Bui Quang Diep, Gyeonggi-do (KR); Seong-Sik Myoung, Gyeonggi-do (KR); Jae-Hun Lee, Gyeonggi-do (KR)

(72) Inventors: Jae-Won Choi, Gyeonggi-do (KR); Jong-Soo Lee, Gyeonggi-do (KR); Dae-Hyun Kwon, Seoul (KR); Bui Quang Diep, Gyeonggi-do (KR); Seong-Sik Myoung, Gyeonggi-do (KR); Jae-Hun Lee, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 16 days.

(21) Appl. No.: 14/991,408

(22) Filed: Jan. 8, 2016

(65) Prior Publication Data

US 2016/0209861 A1 Jul. 21, 2016

Related U.S. Application Data

(60) Provisional application No. 62/105,965, filed on Jan. 21, 2015.

(30) Foreign Application Priority Data

May 11, 2015 (KR) ..... 10-2015-0065458

(51) Int. Cl.
*G05F 3/26* (2006.01)
*G05F 3/24* (2006.01)
(Continued)

(52) U.S. Cl.
CPC ..... *G05F 3/267* (2013.01); *G05F 3/242* (2013.01); *G05F 1/462* (2013.01); *G05F 1/567* (2013.01); *G05F 3/245* (2013.01)

(58) Field of Classification Search
CPC ... G05F 3/08; G05F 3/267; G05F 3/26; G05F 3/30; G05F 3/16; G05F 1/461; G05F 1/462; G05F 1/567; G05F 3/242; G05F 3/225
See application file for complete search history.

(56) References Cited

U.S. PATENT DOCUMENTS 6,078,208 A * 6/2000 Nolan ..... G01K 7/01 327/512
6,222,470 B1 * 4/2001 Schuelke ..... G05F 3/30 327/513

(Continued)

FOREIGN PATENT DOCUMENTS

| | | |
|---|---|---|
| JP | 2013171315 | 9/2013 |
| KR | 1020090048295 | 5/2009 |
| KR | 1020100070572 | 6/2010 |

*Primary Examiner* — Gustavo Rosario Benitez
(74) *Attorney, Agent, or Firm* — The Farrell Law Firm, P.C.

(57) ABSTRACT

Disclosed are a temperature compensation apparatus and method. The apparatus includes a reference signal generator that supplies at least one of a first current which is constant regardless of temperature variation and a second current which is proportional to temperature variation, a slope amplifier that determines a first output current having a second temperature coefficient which is a multiple of a first temperature coefficient of the second current, based on the first current and the second current, and a slope controller that determines a second output current having a third temperature coefficient, using a weighted average of the first current and the second current.

20 Claims, 16 Drawing Sheets

(51) Int. Cl.
*G05F 1/46* (2006.01)
*G05F 1/567* (2006.01)

(56) References Cited

U.S. PATENT DOCUMENTS

| | | | | |
|---|---|---|---|---|
| 6,346,848 | B1 | 2/2002 | Shkap | |
| 6,356,161 | B1 * | 3/2002 | Nolan | H03K 3/0231 331/111 |
| 6,556,155 | B1 | 4/2003 | Wiles | |
| 6,879,214 | B2 | 4/2005 | LeSage et al. | |
| 7,177,612 | B2 | 2/2007 | Nakamura et al. | |
| 7,372,448 | B2 * | 5/2008 | Kim | G01K 1/02 345/102 |
| 8,797,094 | B1 * | 8/2014 | Washburn | G05F 1/561 323/313 |
| 2003/0001660 | A1 | 1/2003 | Yang | |
| 2003/0080807 | A1 | 5/2003 | Dasgupta et al. | |
| 2006/0097790 | A1 | 5/2006 | Bokatius | |
| 2007/0098041 | A1 * | 5/2007 | Seo | G01K 7/00 374/170 |
| 2008/0284501 | A1 | 11/2008 | Kim | |
| 2009/0121699 | A1 | 5/2009 | Park et al. | |
| 2010/0060345 | A1 * | 3/2010 | Huang | G05F 3/30 327/539 |
| 2010/0295529 | A1 * | 11/2010 | Consoer | G05F 3/30 323/313 |
| 2013/0099769 | A1 | 4/2013 | Fan | |

* cited by examiner (WITH TCDBL)

(WITHOUT TCDBL)

APPARATUS FOR COMPENSATING FOR TEMPERATURE AND METHOD THEREFOR

PRIORITY

This application claims priority under 35 U.S.C. §119(e) to U.S. Provisional Patent Application Ser. No. 62/105,965, which was filed in the United States Patent and Trademark Office on Jan. 21, 2015 and under 35 U.S.C. §119(a) to Korean Application Serial No. 10-2015-0065458, which was filed in the Korean Intellectual Property Office on May 11, 2015, the contents of each of which are incorporated herein by reference.

BACKGROUND

1. Field of the Disclosure

The present disclosure relates generally to a temperature compensation apparatus and method and, more particularly, to a temperature compensation apparatus and method for supplying a bias to a power detector.

2. Description of the Related Art

A Radio Frequency Integrated Circuit (RFIC) transceiver is widely used in modern wireless communication. The transceiver generally comprises a receiver (RX) path and a transmitter (TX) path. The RX path can down-convert a reception signal into a baseband signal, and the TX path modulates a signal and up-convert a baseband signal into a high frequency band signal (e.g. an RF signal).

In the transceiver, the power detector detects transmission power from an output of the TX, and a modem controls a TX switch based on the information of the power detector, in order to optimize power consumption of a mobile terminal or improve the linearity of a Power Amplifier (PA). The power detector requires robustness against temperature variation for accurately detecting power.

The performance of the power detector changes as temperature changes, but can be compensated for by a design of a suitable bias circuit, such as a Proportional To an Absolute Temperature (PTAT) circuit or a Band Gap Reference (BGR) circuit. The BGR circuit supplies a constant current (hereinafter, "BGR current"), which is constant regardless of a change in manufacturing processes or neighboring temperature, and the PTAT circuit supplies a current (hereinafter, "PTAT current"), which is linearly proportional to an absolute temperature. The PTAT circuit provides a bias current to a power amplifier together with the BGR circuit. The BGR circuit and the PTAT circuit offset temperature dependency, and compensate for an output voltage of a transconductance-dependent block through temperature variation.

The output voltage of the power detector should be compensated for temperature variation to provide a modem with accurate transmission output power information regardless of the temperature variation. The PTAT circuit can compensate for a change of an analog circuit within the power detector by providing a compensated bias current.

The conventional bias circuit only uses the BGR and PTAT circuits, and has approximately 15% of fixed and limited slope rate regarding temperature variation.

FIG. 1 illustrates a PTAT current value according to temperature variation, according to the related art. In the graph of FIG. 1, the x-axis indicates temperature, and the y-axis indicates a PTAT current value.

Referring to FIG. 1, when temperature changes from −30 degrees Celsius to 90 degrees Celsius, FIG. 1 illustrates that the PTAT current changes approximately from 10 [μA] to 14 [μA]. A slope of a PTAT current is approximately 15%, and indicates a rate of change in current according to temperature.

However, the power detector may require a slope in which a rate of change in current according to temperature is greater than or equal to 45% for compensating for a change in gain and providing performance of the power detector which is insensitive to temperature. The performance of the power detector requires optimization throughout other operation bandwidths through a slope control ability of the current PTAT circuit.

Accordingly, there is a need in the art for additional bias circuits to better control current, and a current slope for increasing compensation for performance degradation of the power detector due to temperature.

SUMMARY

Accordingly, the present disclosure has been made to address at least the problems and/or disadvantages described above and to provide at least the advantages described below.

Accordingly, an aspect of the present disclosure is to provide a temperature compensation apparatus and method for supplying a bias current for the power detector.

Another aspect of the present disclosure is to provide a temperature compensation apparatus and method for performing a current control so that a rate of change in current according to temperature is greater than or equal to 15% for compensating for degradation of an output voltage of the power detector, which is caused by temperature variation.

According to an aspect of the present disclosure, an apparatus for compensating for temperature includes a reference signal generator that supplies at least one of a first current which is constant regardless of temperature variation and a second current which is proportional to the temperature variation, a slope amplifier that determines a first output current having a second temperature coefficient, which is a multiple of a first temperature coefficient of the second current, based on the first current and the second current, and a slope controller that determines a second output current having a third temperature coefficient, using a weighted average of the first current and the second current.

According to another aspect of the present disclosure, a method for compensating for temperature in a device includes supplying at least one of a first current which is constant regardless of temperature variation and a second current which is proportional to the temperature variation, determining a first output current having a second temperature coefficient which is a multiple of a first temperature coefficient of the second current, based on the first current and the second current, and determining a second output current having a third temperature coefficient, using a weighted average of the first current and the second current.

According to another aspect of the present disclosure, a device chip set includes a reference signal generator that supplies at least one of a first current which is constant regardless of temperature variation and a second current which is proportional to the temperature variation, a slope amplifier that determines a first output current having a second temperature coefficient, which is a multiple of a first temperature coefficient of the second current, based on the first current and the second current, and a slope controller that determines a second output current having a third temperature coefficient, using a weighted average of the first current and the second current.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION OF EMBODIMENTS OF THE PRESENT DISCLOSURE

Figure 1:
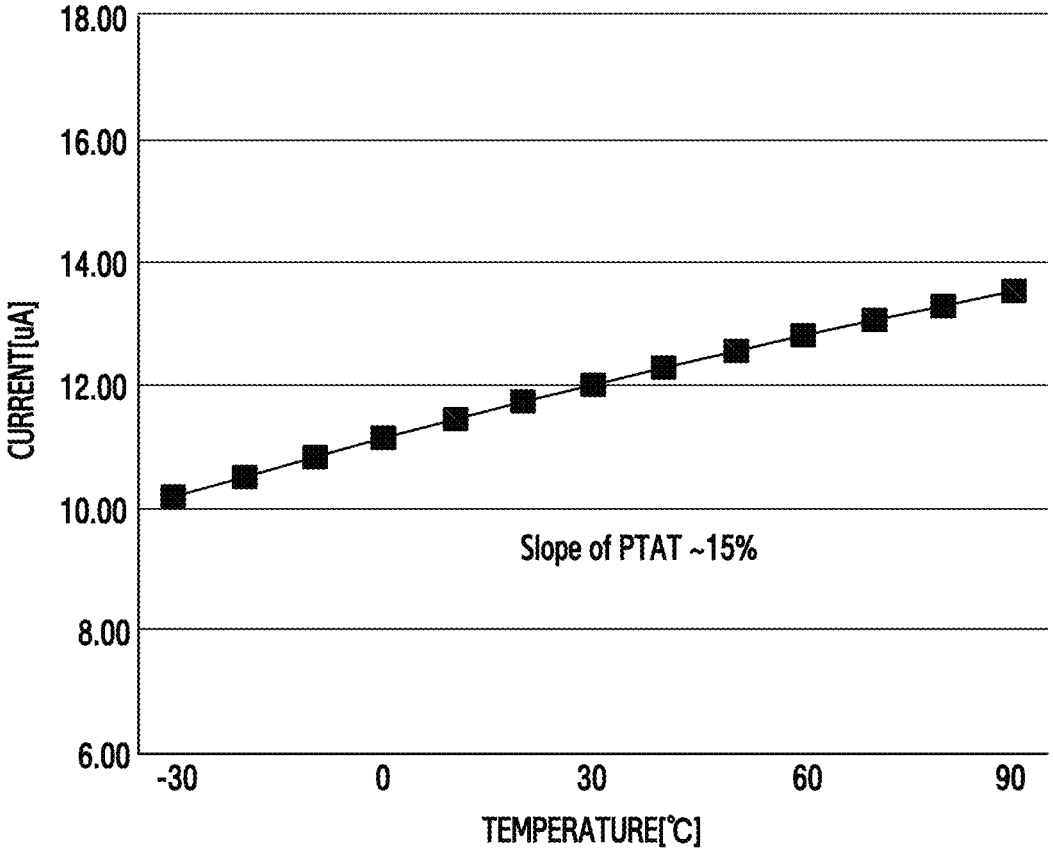
PRIOR ART FIG. 1
FIG. 1 illustrates a PTAT current value according to temperature variation, according to the related art.

Embodiments of the present disclosure will be described in detail with reference to the attached drawings. In the following description, specific details such as detailed configuration and components are merely provided to assist the overall understanding of these embodiments of the present disclosure. Therefore, it should be apparent to those skilled in the art that various changes and modifications of the embodiments described herein can be made without departing from the scope and spirit of the present disclosure. In addition, descriptions of well-known functions and constructions are omitted for clarity and conciseness. In the following description the same or similar reference numerals may be used to refer to the same or similar elements.

When it is mentioned that an element such as a layer, a region or a wafer (substrate) is placed "on", "by being connected to" or "by being coupled to" a different element, throughout the specification, it can be interpreted that the element can come into contact with the different element directly "on", "by being connected to" or "by being coupled to" the different element, or that other elements interposed therebetween can exist. However, when it is mentioned that an element is placed "directly on", "directly by being connected to" or "directly by being coupled to" a different element, it is interpreted that no other elements are interposed therebetween. As used in the present specification, the term "and/or" includes any and all combinations of one or more of the corresponding listed items.

Herein, although terms such as first and second may be used in to describe various members, components, regions, layers and/or sections, these members, components, regions, layers and/or sections should not be limited by these terms. Instead, these terms are only used to distinguish one member, component, region, layer or section from another region, layer or section. Thus, a first member, component, region, layer or section may be referred to as a second member, component, region, layer or section without departing from the teachings of the present disclosure.

Relative terms, such as "upper" or "up", and "lower" or "down" may be used herein to describe the relationship of some elements to another elements as illustrated in the drawings. It will be understood that relative terms are intended to encompass different orientations of the device, in addition to the orientation depicted in the drawings. For example, if the device in the drawings is turned over, elements described to exist on a surface of an upper portion of other elements would then have the orientation to a surface of a lower portion of the other elements described above. Thus, the term "upper" can encompass both orientations of "lower" and "upper" depending on specific orientations of the drawings. If elements are otherwise oriented (rotated 90 degrees or at other orientations), the relative descriptors used in the present specification may be interpreted accordingly.

As used in the present specification, the singular forms "a", "an" and "the" are intended to include the plural forms as well, unless the context clearly indicates otherwise. The terms "comprises" and/or "comprising," when used in this specification, specify the presence of stated shapes, numbers, steps, operations, members, elements, and/or groups thereof, but do not preclude the presence or addition of one or more other shapes, numbers, steps, operations, members, elements, and/or groups.

In the drawings, modifications from the shapes of the illustrations according to, for example, manufacturing techniques and/or tolerances can be expected. Thus, embodiments of the present disclosure should not be interpreted as being limited to a particular shape of a region illustrated in the present specification but should include changes in a shape that results from manufacturing, for example. Hereinafter, embodiments may be configured by combining one or plural embodiments.

While a temperature compensation apparatus described hereinafter can have various configurations, necessary configurations only are provided as an example herein, and the content of the present disclosure is not limited to the necessary configurations.

The present disclosure implements a temperature compensation circuit having a higher temperature coefficient than that of the PTAT circuit, using the PTAT current and the BGR current, thereby reducing an output voltage fluctuation according to temperature variation of a relevant device by supplying a bias to the relevant device based on a high temperature coefficient.

Figure 2:
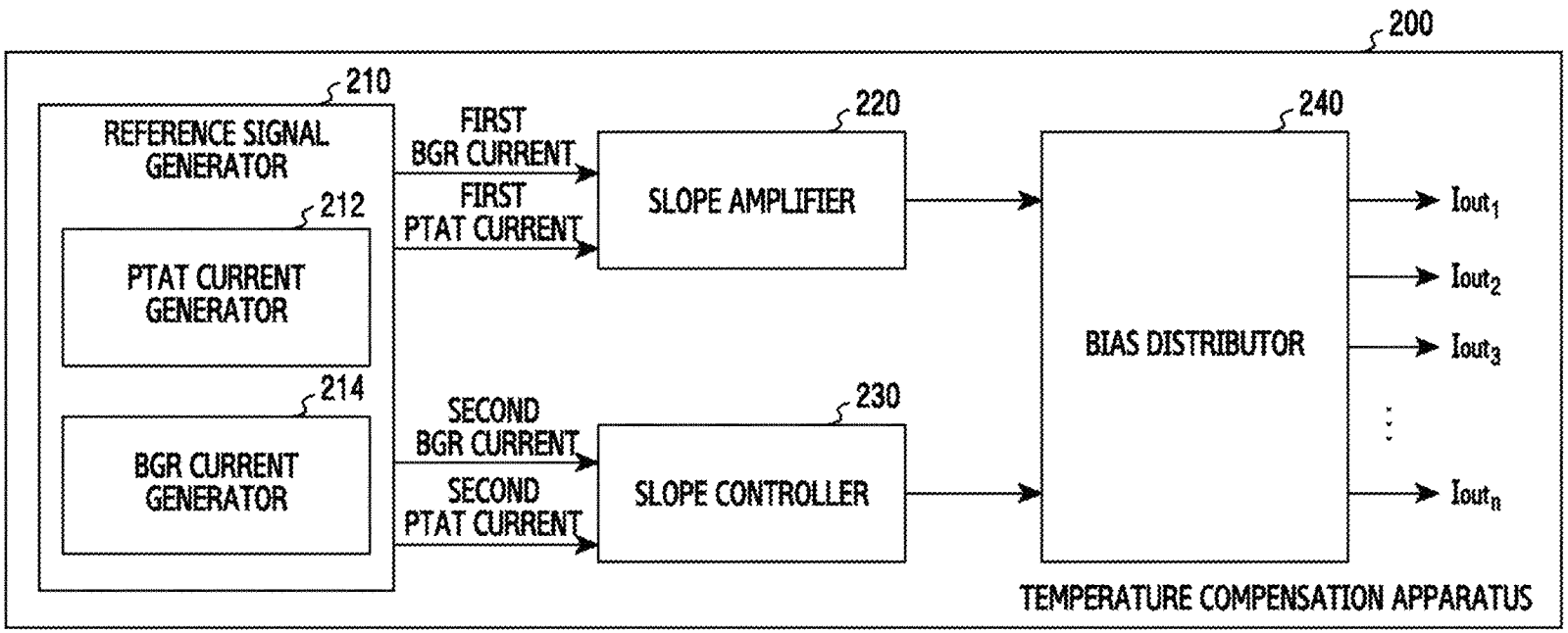
FIG. 2 illustrates a temperature compensation apparatus according to embodiments of the present disclosure.

FIG. 2 illustrates a temperature compensation apparatus according to embodiments of the present disclosure.

Referring to FIG. 2, a temperature compensation apparatus 200 includes a reference signal generator 210, a slope amplifier 220, a slope controller 230, and a bias distributor 240. The reference signal generator 210 includes a PTAT current generator 212 and a BGR current generator 214.

The reference signal generator 210 can be implemented by a PTAT circuit and a BGR circuit, and supplies a BGR current, which is constant regardless of a change in manufacturing processes or neighboring temperature, and a PTAT current, which is linearly proportional to an absolute temperature.

The reference signal generator 210 supplies the BGR current and the PTAT current to the slope amplifier 220 and the slope controller 230. For example, the reference signal generator 210 outputs a first BGR current and a first PTAT current to the slope amplifier 220. The reference signal generator 210 outputs a second BGR current and a second PTAT to the slope controller 230. The first BGR current and the second BGR current can be identical or different, and the first PTAT current and the second PTAT current also can be identical or different.

The slope amplifier 220 generates a first output current based on the first BGR current and the first PTAT current supplied from the reference signal generator 210. For example, the first output current can be determined as the difference between the doubled first PTAT current and the first BGR current.

The slope controller 230 generates a second output current based on the second BGR current and the second PTAT current supplied from the reference signal generator 210. For example, the second output current can be determined by the sum of $\alpha$ times the second BGR current and $1-\alpha$ times the second PTAT current, in an operation referred to herein as a weighted average.

The parameter $\alpha$ is used to determine a ratio of the second BGR current to the second PTAT current in the second output current. For example, the second output current is identical to the second PTAT current when $\alpha=0$, the second output current is identical to the second BGR current when $\alpha=1$, and the second output current is determined by the sum of 50% of the second BGR current and 50% of the second PTAT current when $\alpha=0.5$.

A bias distributor 240 supplies a bias to a corresponding device (e.g. a power detector, an A/D converter or D/A converter), using the first output current from the slope amplifier 220 and the second output current from the slope controller 230. For example, the bias distributor 240 distributes the first output current or the second output current to at least one device as-is or distributes the third output current obtained by multiplying the first output current and the second output current by parameters such as $\alpha$ or $\beta$, respectively, to at least one device.

Figure 3:
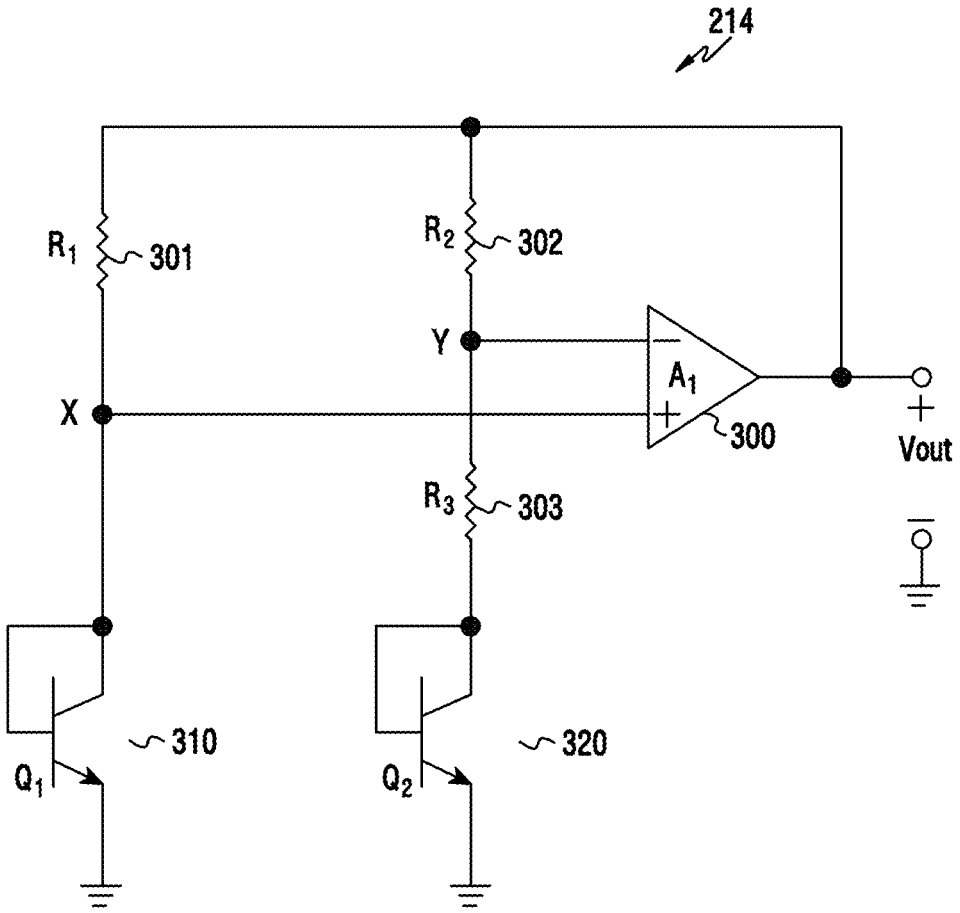
FIG. 3 is a circuit diagram for a BGR current generator of a temperature compensation apparatus according to embodiments of the present disclosure.

FIG. 3 is a circuit diagram for a BGR current generator of a temperature compensation apparatus according to embodiments of the present disclosure.

Referring to FIG. 3, the BGR circuit 214 includes an OPerational AMPlifier (OP AMP) 300, two bipolar transistors Q1 310 and Q2 320, and resistors R1 301, R2 302, and R3 303. When a same voltage level is applied to the two input terminals X and Y of the OP AMP 300 in the BGR circuit 214, a reference voltage having a uniform voltage level $V_{ref}$ is applied to a common node of the resistors R1 301 and R2 302, and is generated.

The reference voltage $V_{ref}$ is influenced, for example, by a temperature, a thermal voltage $V_T$, and the resistors R1 301, R2 302, and R3 303, and has a negative coefficient with a value of about −2 mV with regard to a temperature, and $V_T$ has a positive coefficient. The reference voltage $V_{ref}$ insensitive to temperature variation can be made by adjusting a coefficient related to the resistors R1 301, R2 302, and R3 303.

The present disclosure is not limited to the BGR circuit 214 illustrated in FIG. 3, and other types of BGR circuits can be applied to the present disclosure.

Figure 4:
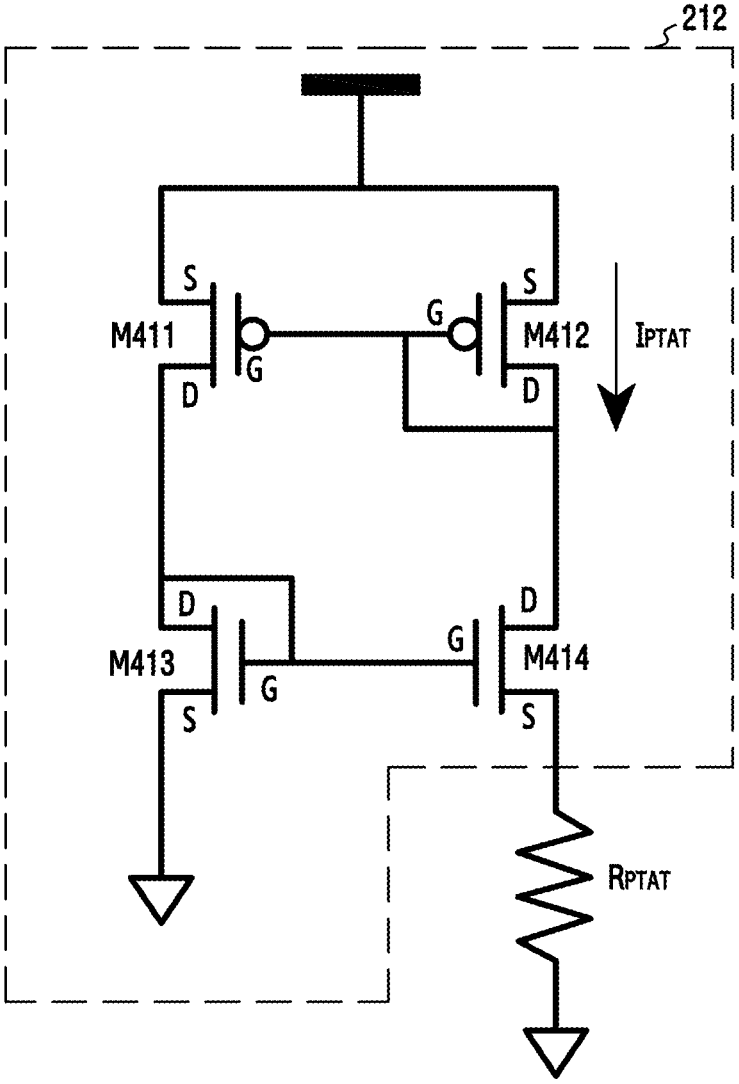
FIG. 4 is a circuit diagram for a PTAT current generator of a temperature compensation apparatus according to embodiments of the present disclosure.

FIG. 4 is a circuit diagram for a PTAT current generator of a temperature compensation apparatus according to embodiments of the present disclosure.

In the PTAT circuit 212, as illustrated in FIG. 4, two Metal-Oxide Semiconductor (MOS) transistors M411 and M412 are connected to a current mirror, two MOS transistors M413 and M414 are connected to the current mirror, the drain (D) of the MOS transistor M411 is connected to the drain (D) of the MOS transistor M413, and the drain (D) of the MOS transistor M412 is connected to the drain (D) of the MOS transistor M414. A power voltage is connected to the source (S) of the MOS transistors M411 and M412, and a grounded voltage is connected to the source (S) of the MOS transistor M413. Thus, the PTAT circuit 212 provides a PTAT current (IPTAT) proportional to temperature to an exterior resistor (RPTAT).

The present disclosure is not limited to the PTAT circuit 212 illustrated in FIG. 4, and other types of PTAT circuits can be applied to the present disclosure.

Figure 5A:
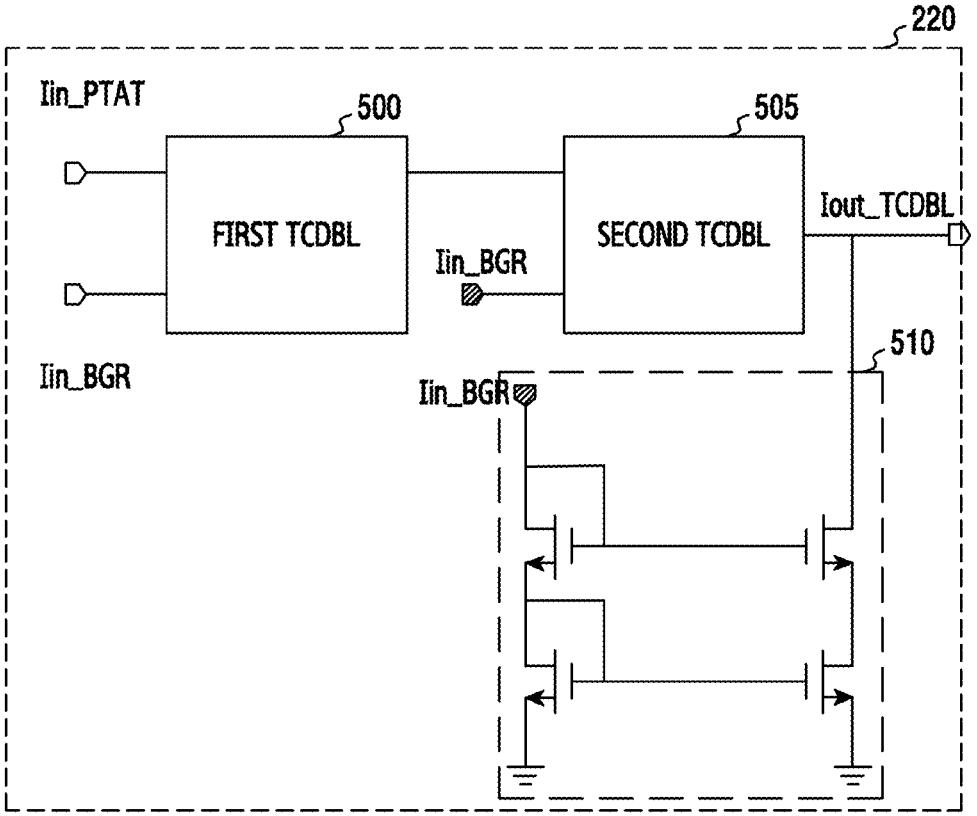
FIG. 5A is a slope amplifier of a temperature compensation apparatus according to embodiments of the present disclosure.

FIG. 5A is a slope amplifier of a temperature compensation apparatus according to embodiments of the present disclosure.

Referring to FIG. 5A, the slope amplifier 220 includes two TCDBLs 500 and 505, and a current mirror 510. However, the current mirror 510 can be omitted from the configuration of the slope amplifier 220 in other embodiments.

The first TCDBL 500 receives the PTAT current Iin_PTAT and the BGR current Iin_BGR, doubles the PTAT current, reduces the doubled PTAT current by the BGR current Iin_BGR, and outputs the PTAT current.

The second TCDBL 505 receives the output current and the BGR current Iin_BGR of the first TCDBL 500, doubles the output current of the first TCDBL 500, reduces the doubled output current of the first TCDBL 500 by the BGR current Iin_BGR, and outputs Iout_TCDBL.

The current mirror 510 is configured by coupling two basic current mirrors together, and operates by receiving the BGR current Iin_BGR and the output current IoutTCDBL of the second TCDBL 505.

The current mirror 510 controls such that an output current Iout_TCDBL of the second TCDBL 505 is output in proportional to a temperature.

Figure 5B:
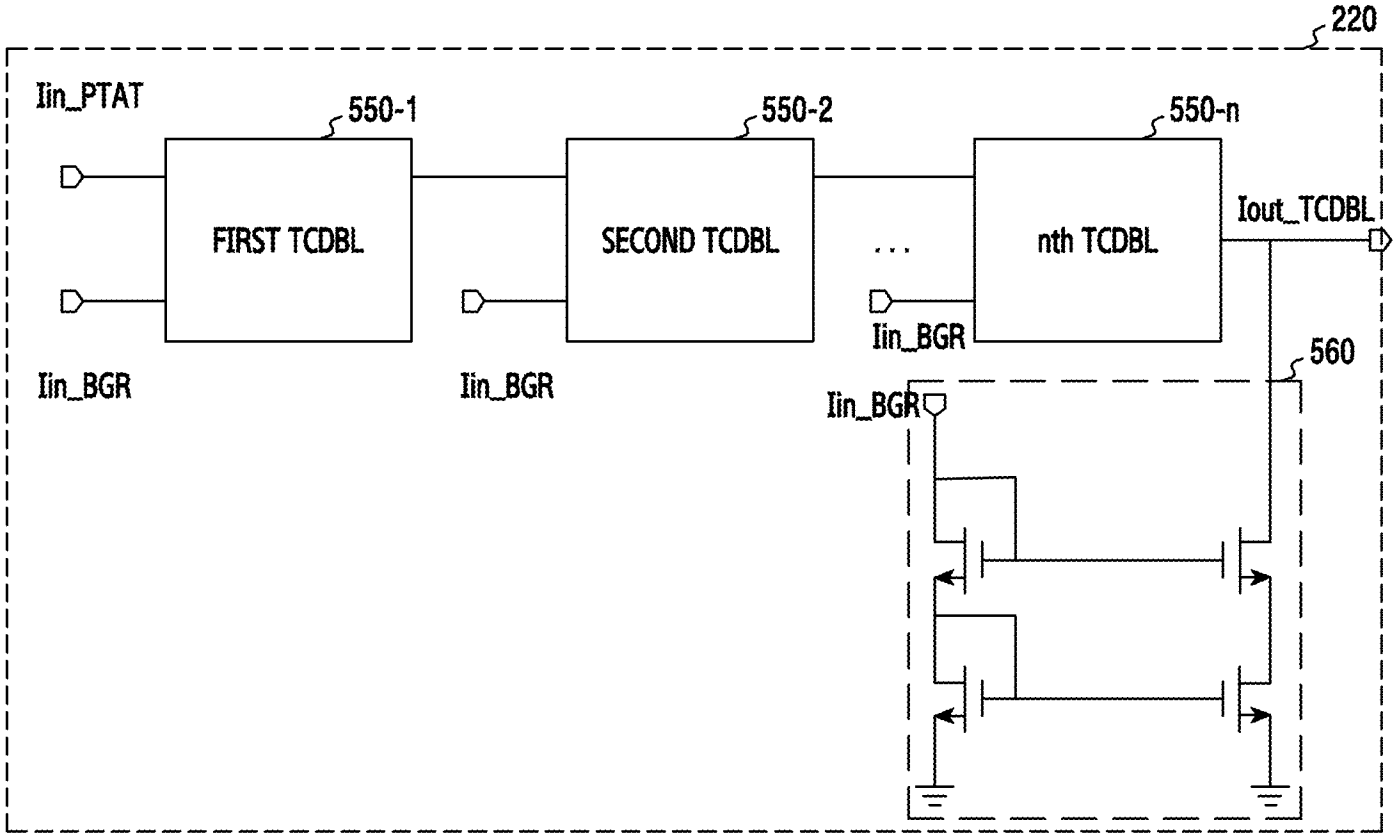
FIG. 5B is a slope amplifier of a temperature compensation apparatus according to embodiments of the present disclosure.

FIG. 5B is a slope amplifier of a temperature compensation apparatus according to embodiments of the present disclosure.

Referring to FIG. 5B, the slope amplifier 220 includes n TCDBLs 550_1, 550_2, . . . , **550_*n*** and a current mirror 560. However, the current mirror 560 can be omitted from the configuration of the slope amplifier 220 in other embodiments.

A first TCDBL 550_1 receives the PTAT current Iin_PTAT and the BGR current Iin_BGR, doubles the PTAT current, reduces the doubled PTAT current by the BGR Iin_BGR, and outputs the PTAT current.

A second TCDBL 550_2 receives the output current and the BGR current Iin_BGR of the first TCDBL 550_1, doubles the output current of the first TCDBL 550_1, reduces the doubled output current of the first TCDBL 550_1 by the BGR current Iin_BGR, and outputs the output current of the first TCDBL 550_1 to a TCDBL 550_3.

A $n_{th}$ TCDBL 550_$n$ receives the output current and the BGR current Iin_BGR of an $n-1_{th}$ TCDBL 550_$n$−1, doubles the output current of the n−1th TCDBL 550_$n$−1, reduces the doubled output current of the $n-1_{th}$ TCDBL 550_$n$−1 by the BGR current Iin_BGR, and outputs Iout_TCDBL.

The current mirror 560 is configured by coupling two basic current mirrors together, and operates by receiving the BGR current Iin_BGR and the output current Iout_TCDBL of the $n_{th}$ TCDBL 550_$n$.

The current mirror 560 controls such that an output current Iout_TCDBL of the $n_{th}$ TCDBL 550_$n$ is output in proportional to a temperature.

Figure 6:
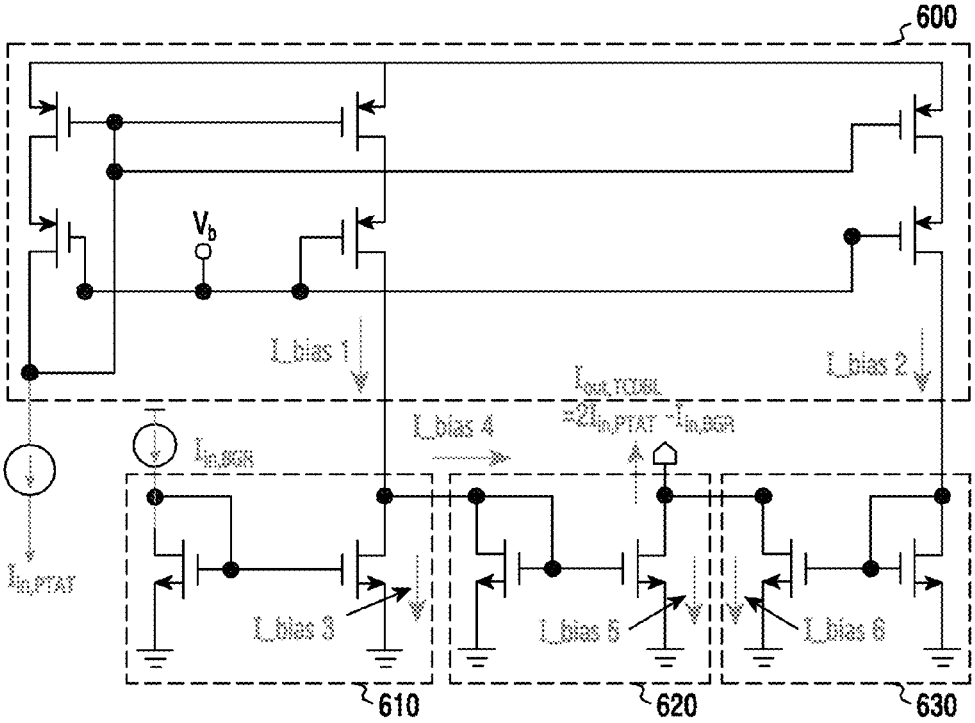
FIG. 6 is a circuit diagram for temperature Coefficient DouBLer (TCDBL) within a slope amplifier according to embodiments of the present disclosure.

FIG. 6 is a circuit diagram for a TCDBL within a slope amplifier according to embodiments of the present disclosure.

Referring to FIG. 6, a circuit for TCDBLs 500, 505, and 550_1 to 550_$n$ is configured to be connected to a plurality of current mirrors 600, 610, 620, and 630.

Current mirror 600 converts the PTAT current Iin_PTAT into $I_{bias1}$ and $I_{bias2}$ and outputs $I_{bias1}$ and $I_{bias2}$ based on a bias reference voltage Vb and a transistor mirroring.

$I_{bias1}$ and $I_{bias2}$ are defined by Equation (1) as follows:

$$I_{bias1}=\alpha_1 I_{in,PTAT}$$

$$I_{bias2}=\alpha_2 I_{in,PTAT} \quad (1)$$

In Equation (1), α1 and α2 are parameter values influenced by a transistor.

The current mirror 610 converts the BGR current Iin_BGR into $I_{bias3}$ and outputs $I_{bias3}$ by receiving the BGR current Iin_BGR. $I_{bias3}$ is defined by Equation (2) as follows:

$$I_{bias3}=\beta I_{in,BGR} \quad (2)$$

In Equation (2), β is a parameter value influenced by the transistor.

Based on Kirchhoffs law, $I_{bias1}$ is distributed into $I_{bias3}$ and $I_{bias4}$ for supply to current mirror 610 and current mirror 620, respectively. For example, $I_{bias3}$ is supplied to current mirror 610 and $I_{bias4}$ is provided to current mirror 620. Thus, $I_{bias3}$ is defined by Equation (3) as follows:

$$I_{bias4}=I_{bias1}-I_{bias3}=\alpha_1 I_{in,PTAT}-\beta I_{in,BGR} \quad (3)$$

Current mirror 620 converts $I_{bias4}$ into $I_{bias5}$ and outputs $I_{bias5}$ by receiving $I_{bias4}$. $I_{bias5}$ is defined by Equation (4) as follows:

$$I_{bias5}=\gamma_1 I_{bias4}=\gamma_1(\alpha_1 I_{in,PTAT}-\beta I_{in,BGR}) \quad (4)$$

Current mirror 630 converts $I_{bias2}$ into $I_{bias6}$ and outputs $I_{bias6}$ by receiving $I_{bias2}$ from current mirror 600. $I_{bias6}$ is defined by Equation (5) as follows:

$$I_{bias6} = \gamma_2 I_{bias2} = \alpha_2\gamma_2 I_{in,PTAT} \quad (5)$$

Current mirror 620 supplies an output current $I_{TcDBL}$ of TCDBLs 500, 505, and 550_1 to 550_$n$. $I_{out,\ TCDBL}$ is defined by Equation (6) as follows:

$$I_{out,TCDBL} = -(I_{bias5} + i_{bias6}) = -[\gamma_1(\alpha_1 I_{in,PTAT} - \beta I_{in,BGR}) + \alpha_2\gamma_2 I_{in,PTAT}] \quad (6)$$

In Equation (6), when α1, α2, β=1, the result is shown in the following expression:

$$=-(2I_{in,PTAT}-I_{in,BGR})$$

Figure 7:
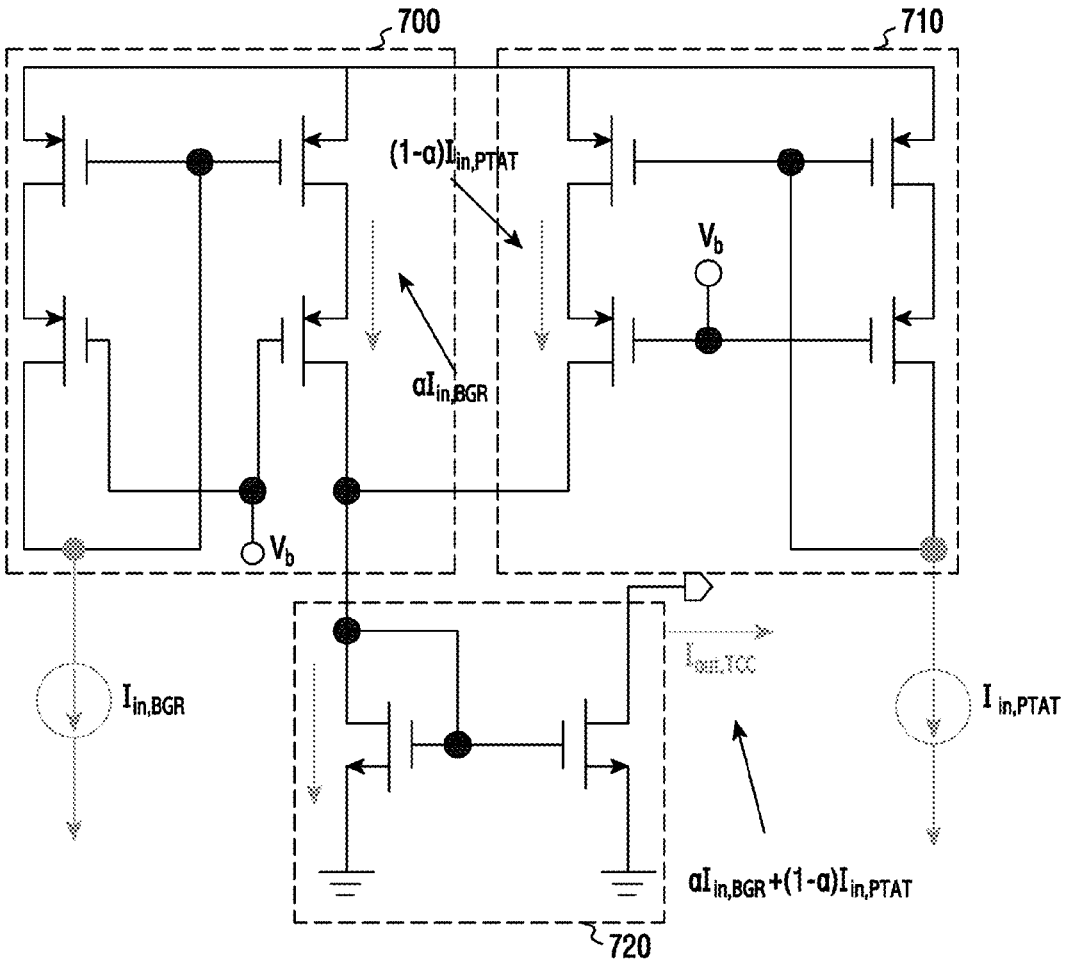
FIG. 7 is a detailed circuit diagram for a slope controller of a temperature compensation apparatus according to embodiments of the present disclosure.

FIG. 7 is a detailed circuit diagram for a slope controller of a temperature compensation apparatus according to embodiments of the present disclosure.

Referring to FIG. 7, the slope controller 230 includes a plurality of current mirrors 700, 710 and 720.

Current mirror 700 converts $I_{in,\ BGR}$ supplied from the reference signal generator 210 into $\alpha I_{in,BGR}$ and outputs $\alpha I_{in,BGR}$ to current mirror 720.

Current mirror 710 converts $I_{in,PTAT}$ supplied from the reference signal generator 210 into $(1-\alpha)I_{in,PTAT}$ and outputs $(1-\alpha)I_{in,PTAT}$ to current mirror 720. α is a parameter influenced by the transistor.

Current mirror 730 copies $\alpha I_{in,BGR}$ of current mirror 700 and a signal to which $(1-\alpha)I_{in,PTAT}$ has been added and outputs the signal.

For example, current mirror 720 copies $\alpha I_{in,BGR}+(1-\alpha)I_{in,PTAT}$ and outputs $\alpha I_{in,BGR}+(1-\alpha)I_{in,PTAT}$ through an output terminal.

Thus, the output current $I_{out,TCC}$ of the slope controller 230 is defined by Equation (7) as follows:

$$I_{out,TCC}=\alpha I_{in,BGR}+(1-\alpha)I_{in,PTAT} \quad (7)$$

Figure 8:
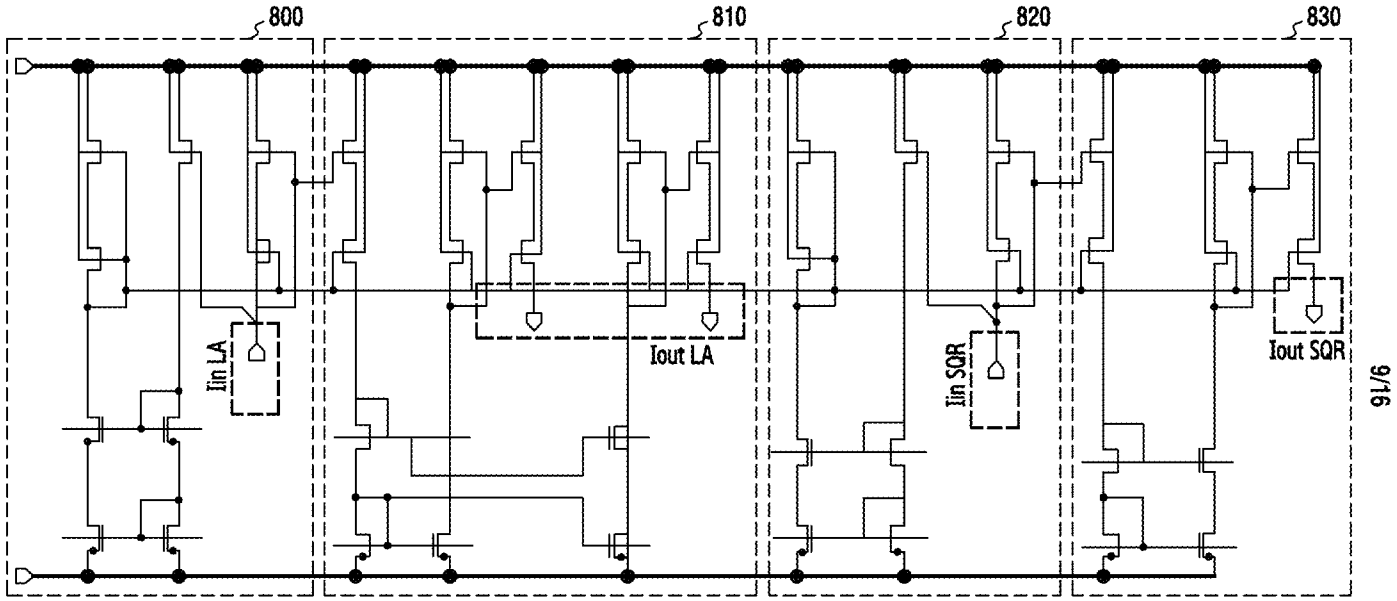
FIG. 8 is a detailed circuit diagram for a bias distributor of a temperature compensation apparatus according to embodiments of the present disclosure.

FIG. 8 is a detailed circuit diagram for a bias distributor of a temperature compensation apparatus according to embodiments of the present disclosure.

Referring to FIG. 8, a bias distributor 240 is classified as a plurality of input terminals 800 and 820, and a plurality of output terminals 810 and 830.

The input terminals 800 and 820 are configured as a current mirroring, respectively receive the output current $I_{out,TCDBL}$ of the slope amplifier 220 and the output current $I_{out,TCC}$ of the slope controller 230 as input signals, and respectively output the input signals to the output terminals 810 and 830.

For example, input terminal 800 copies $I_{out,TCC}$ as an input signal (hereinafter, "$I_{in\ LA}$") and provides the input signal to the output terminal 810. The input terminal 820 copies $I_{out,TCDBL}$ as an input signal (hereinafter, "$I_{in\ SQR}$") and provides the input signal to the output terminal 830.

Similarly, the output terminals 810 and 830 are configured as a current mirroring, and copy an input signal from the input terminal 800 as at least one output signal and outputs the output signal.

For example, the output terminal 810 copies two $I_{in\ LA}$s and outputs the two $I_{out\ LA}$s. For example, the output terminal 810 outputs a first $I_{out\ LA}$ and a second $I_{out\ LA}$ including two output ports (i.e. including two power mirrors), where $I_{in\ LA}$ and $I_{out\ LA}$ can be identical to or different from each other. For example, $I_{out\ LA}$ can be determined as $\alpha I_{in\ LA}$. In an embodiment, $I_{in\ LA}$ can be identical to the first $I_{out\ LA}$, and different from the second $I_{out\ LA}$. As such, the first $I_{out\ LA}$ and the second $I_{out\ LA}$ can be different from each other.

Although it is described that the output terminal 810 has two output ports in FIG. 8, the output terminal 810 can also have two or more output ports. For example, when the number of devices which are to supply a bias is n, the output terminal 810 can have n or more output ports.

The output terminal 830 copies one $I_{in\ SQR}$ and outputs one output signal $I_{out\ SQR}$. For example, the output terminal 830 outputs $I_{out\ SQR}$ including one output port (i.e. including one power mirror). $I_{in\ SQR}$ and $I_{out\ SQR}$ can be identical to or different from each other. For example, $I_{out\ SQR}$ can be determined as $\alpha I_{in\ SQR}$.

Although it is illustrated that the output terminal 830 has one output port in FIG. 8, the output terminal 830 could have more than one output port in other embodiments. For example, when the number of devices that are to supply a bias is n, the output terminal 830 can have n or more output ports.

Figure 9:
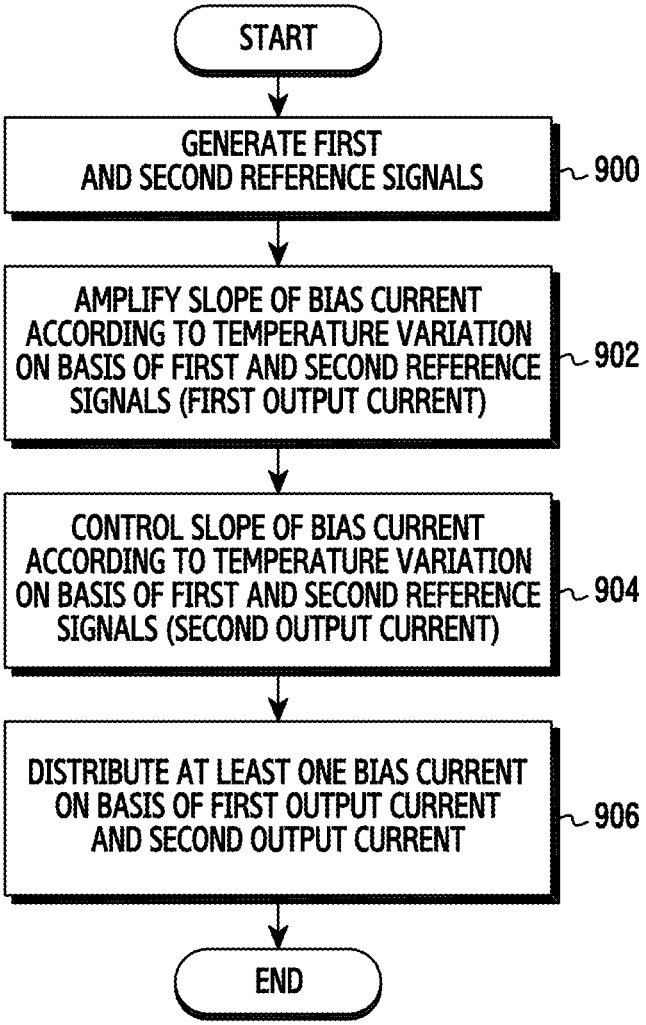
FIG. 9 is an operation flow chart of a temperature compensation apparatus according to embodiments of the present disclosure.

FIG. 9 is an operation flow chart of a temperature compensation apparatus according to embodiments of the present disclosure.

Referring to FIG. 9, a temperature compensation apparatus 200 generates at least one of a first reference signal and a second reference signal in step 900. The first reference signal can be a BGR current which is constant regardless of a change in manufacturing processes or neighboring temperature, and the second reference signal can be a PTAT current which is linearly proportional to an absolute temperature.

The temperature compensation apparatus 200 generates a first output current, based on the first reference signal and the second reference signal in step 902. Specifically, the first output current is determined by the difference between the doubled second reference signal and the first reference signal, using Equation (6).

The temperature compensation apparatus 200 generates a second output current, based on the first reference signal and the second reference signal in step 904. Specifically, the second output current is determined through a weighted average of the first reference signal and the second reference signal, such as the sum of $\alpha$ times the first reference signal and $1-\alpha$ times the second reference signal, using Equation (7). In this expression, $\alpha$ is a parameter used to determine a ratio of the first reference signal to the second reference signal in the second output current. For example, the second output current is identical to the second reference signal when $\alpha=0$, and the second output current is identical to the first reference signal when $\alpha=1$ and is determined by the sum of 50% of the first reference signal and 50% of the second reference signal when $\alpha=0.5$.

The temperature compensation apparatus 200 supplies a bias to a corresponding device, such as a power detector, an Analog/Digital (A/D) converter, or D/A converter, using the first output current and the second output current in step 906. For example, the temperature compensation apparatus 200 distributes the first output current or the second output current to at least one device as-is or distributes the third output current obtained by multiplying the first output current and the second output current by parameters to at least one device.

Figure 10:
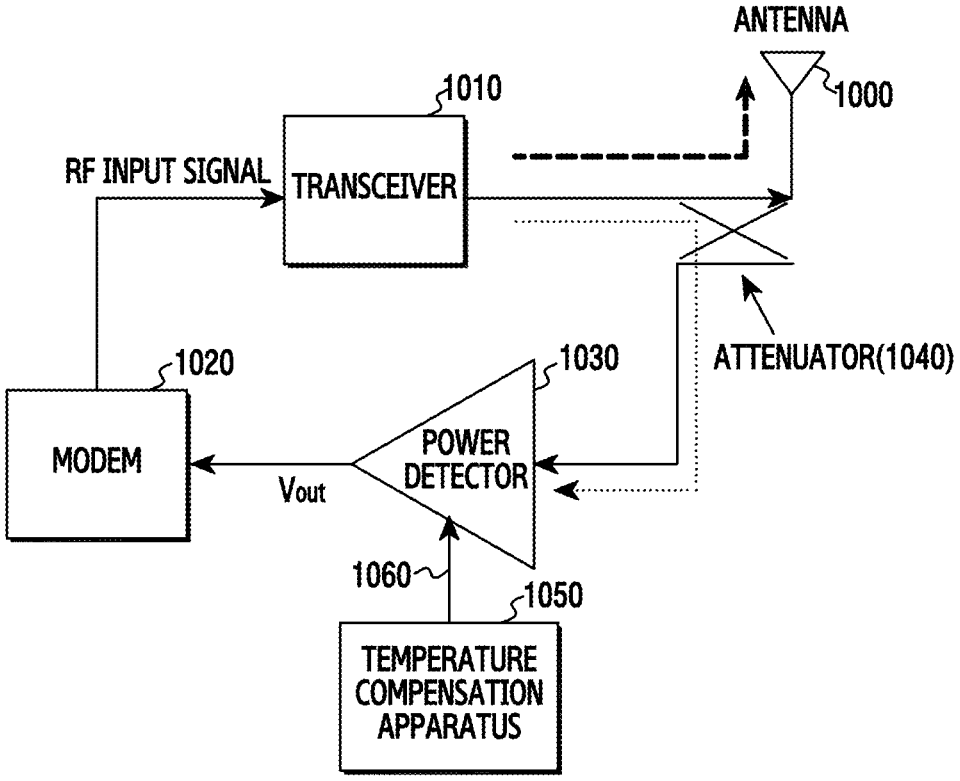
FIG. 10 illustrates a communication device according to embodiments of the present disclosure.

FIG. 10 illustrates a communication device according to embodiments of the present disclosure.

Referring to FIG. 10, the communication device includes an antenna 1000, a transceiver 1010, a modem 1020, a power detector 1030, an attenuator 1040, and a temperature compensation apparatus 1050. Although a power amplifier is not illustrated herein, the power amplifier can be further included between the transceiver 1010 and the antenna 1000. According to embodiments, a Power Amplifier Module (PAM) including a plurality of power amplifiers can be further included between the transceiver 1010 and the antenna 1000.

The modem 1020 modulates a baseband signal and outputs the baseband signal to the transceiver 1010 according to a corresponding communication scheme or receives the baseband signal from the transceiver 1010 and demodulates the baseband signal according to the corresponding communication scheme.

The modem 1020 receives information on the size of a transmission output signal (e.g. an average value of the transmission output signal) from the power detector 1030, and determines a gain of the transmission output signal based on the information on the size of the transmission output signal. For example, the modem 1020 raises a gain when power of a transmission output signal, which is detected by the power detector 1030, is less than power of a target transmission output signal, and otherwise lowers the gain.

The transceiver 1010 converts a baseband signal which is output from the modem 1020 into an RF signal and outputs the RF signal to an antenna 1000, or converts an RF signal which is received from the antenna 1000 into a baseband signal and outputs the baseband signal to the modem 1020.

An attenuator 1040 attenuates an RF transmission output signal transmitted through the antenna 1000 and then provides the attenuated RF transmission output signal to the power detector 1030.

The power detector 1030 receives an RF transmission output signal fed back from the attenuator 1040, detects the power or the size of the RF transmission output signal, and provides the detected result to the modem 1020. The output of the power detector 1030 is preferably a DC voltage output.

The power detector 1030 receives at least one bias 1060 from a temperature compensation apparatus 1050 and then detects power, as will be described in detail in FIG. 11 below.

The temperature compensation apparatus 1050 is identical to the temperature compensation apparatus 200 of FIG. 2.

The temperature compensation apparatus 1050 includes a reference signal generator for supplying a BGR current and a PTAT current, a slope amplifier which generates a first output current based on a first BGR current and a first PTAT current supplied from the reference signal generator, a slope controller for generating a second output current based on a second BGR current and a second PTAT current supplied from the reference signal generator, and a bias distributor for supplying a bias to a corresponding device, such as a power detector or an A/D or D/A converter, using the first output current from the slope amplifier and the second output current from the slope controller.

The first output current can be determined by the difference between the doubled first PTAT current and the first BGR current, and the second output current can be determined by the sum of $\alpha$ times the second BGR current and $1-\alpha$ times the second PTAT current.

In a communication device of FIG. 10, although the attenuator 1040, the transceiver 1010, and the power detector 1030 are illustrated as separate elements, these components can be implemented as one chip, such as an RFIC.

Figure 11:
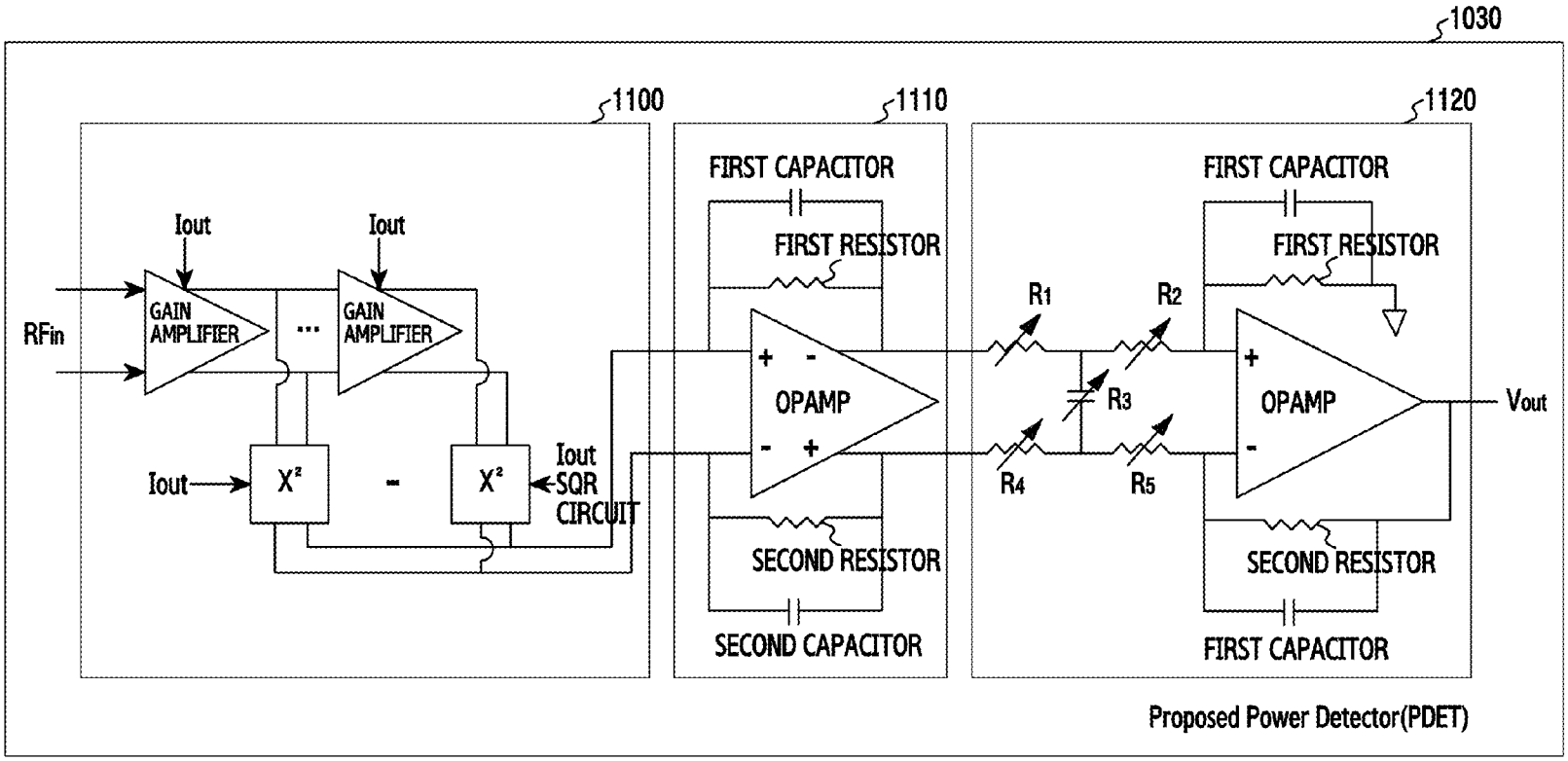
FIG. 11 illustrates the power detector within a communication device according to embodiments of the present disclosure.

FIG. 11 illustrates a power detector of a communication device according to embodiments of the present disclosure.

Referring to FIG. 11, the power detector 1030 includes an RF core block 1100, a first converter 1110, and a second converter 1120.

The RF core block 1100 generates a root mean square of an RF transmission signal and outputs the result to the first converter 1110 as a current signal. The RF core block 1100 includes a plurality of gain amplifiers which amplify a gain of an RF transmission signal, and a plurality of Root Mean Square (RMS) circuits which are connected to each output terminal of the gain amplifiers and generate an RMS of the amplified RF transmission signal.

The number of gain amplifiers and RMS circuits which constitute the RF core block 1100 can be determined according to a range of an RF output power. For example, as the range of the RF output power increases, the number of the gain amplifiers and the RMS circuits increases, and as the range of the RF output power decreases, the number of the gain amplifiers and the RMS circuits decreases.

In the RF core block 1100, performance of an RF core block can be influenced by a temperature indicating performance which can be controlled by a bias circuit. Thus, the bias circuit for the power detector 1030, such as the temperature compensation apparatus 1050, is an important circuit block for guaranteeing stable performance of the power detector 1030 through temperature variation.

Particularly, the power detector 1030 can be used to monitor an output current of a TX, and a value thereof can be used to satisfy target output transmission power. Therefore, it is important to detect a high-precision output voltage. The RF core block 1100 of the power detector 1030 comprises gain amplifiers and square root circuits that have a mutual conductance ($gm \propto Cox(W/L)$) dependency on an operation, and it is desirable to provide a bias to a transistor for allowing a mutual conductance (transconductance (gm)) of the transistor to be unaffected by temperature.

For example, a bias distributor of the temperature compensation apparatus 1050 supplies at least one of a first output current and a second output current to each square root circuit of a power detector. The bias distributor of the temperature compensation apparatus 1050 supplies at least one of a first output current and a second output current to each gain amplifier of the power detector.

Preferably, the bias distributor of the temperature compensation apparatus 1050 supplies at least one first output current to each square root circuit of the power detector, and supplies a second output current to each gain amplifier of the power detector.

The first converter 1110 converts a current signal corresponding to an average square root of the RF transmission signal into a voltage signal. The first converter 1110 includes one operational amplifier (opamp), a first resistor and a first capacitor, and a second resistor and a second capacitor. The first resistor and the first capacitor are connected to a first input terminal and a first output terminal of the opamp, and the second resistor and the second capacitor are connected to a second input terminal and a second output terminal of the opamp.

The second converter 1120 converts the converted voltage signal into a single signal from a differential signal.

The second converter 1120 includes a plurality of variable resistors, one operational amplifier, a first resistor and a first capacitor, and a second resistor and a second capacitor. The first resistor and the first capacitor are connected to a first input terminal and a ground of the operational amplifier, and the second resistor and the second capacitor are connected to a second input terminal and an output terminal of the operational amplifier.

Figure 12:
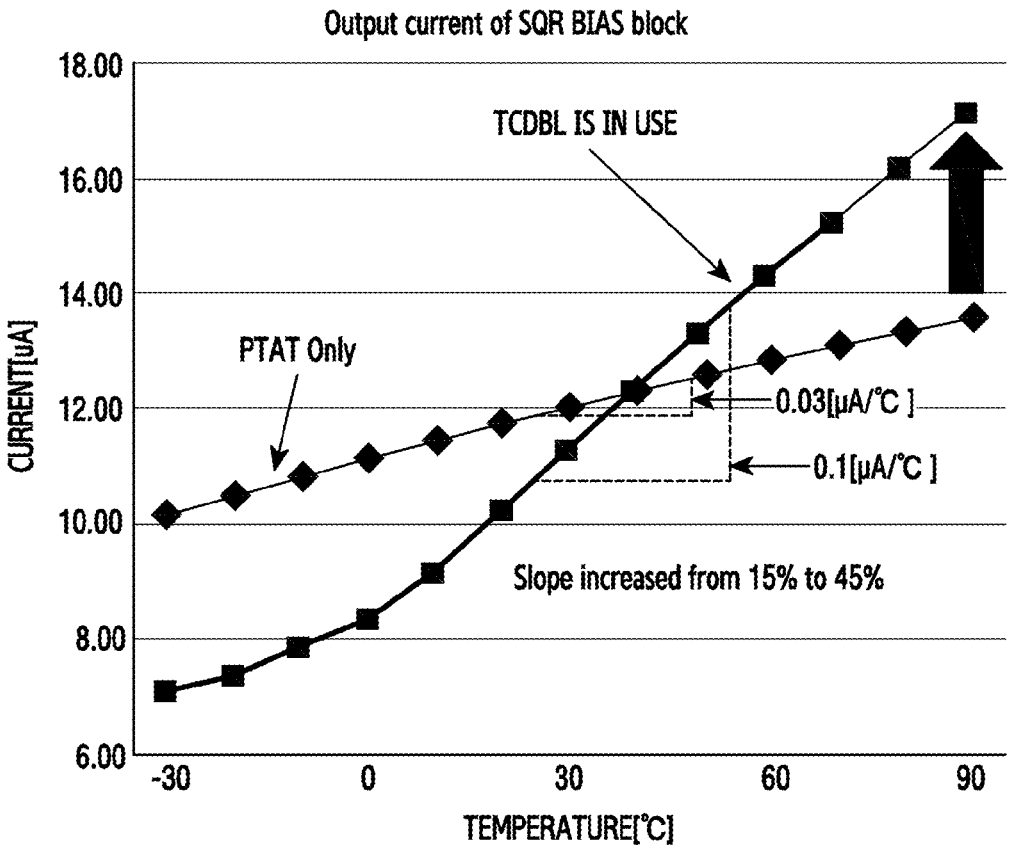
FIG. 12 compares a temperature coefficient at the time of using only a PTAT circuit according to embodiments of the present disclosure with a temperature coefficient at the time of using a slope amplifier.

FIG. 12 compares a temperature coefficient at the time of using only a PTAT circuit according to embodiments of the present disclosure with a temperature coefficient at the time of using a slope amplifier.

Referring to FIG. 12, a slope of a current according to temperature variation when using only a PTAT current is compared with a slope of a current according to temperature variation at the time of using a TCDBL. The temperature coefficient is obtained by dividing a current increase speed at a first temperature by a current increase speed at a second temperature, and has the same meaning as that of a slope of a current.

For example, a slope of a current according to temperature variation when using only a PTAT current is approximately 0.03[uA/° C.], and a slope of a current according to temperature variation when using a TCDBL is approximately 0.1[uA/° C.]. That is, it is evident that current increases by 0.03 uA with every 1° C. of temperature rise when using only a PTAT current, and current increases by 0.1 uA with every 1° C. of temperature rise when using a TCDBL.

Figure 13:
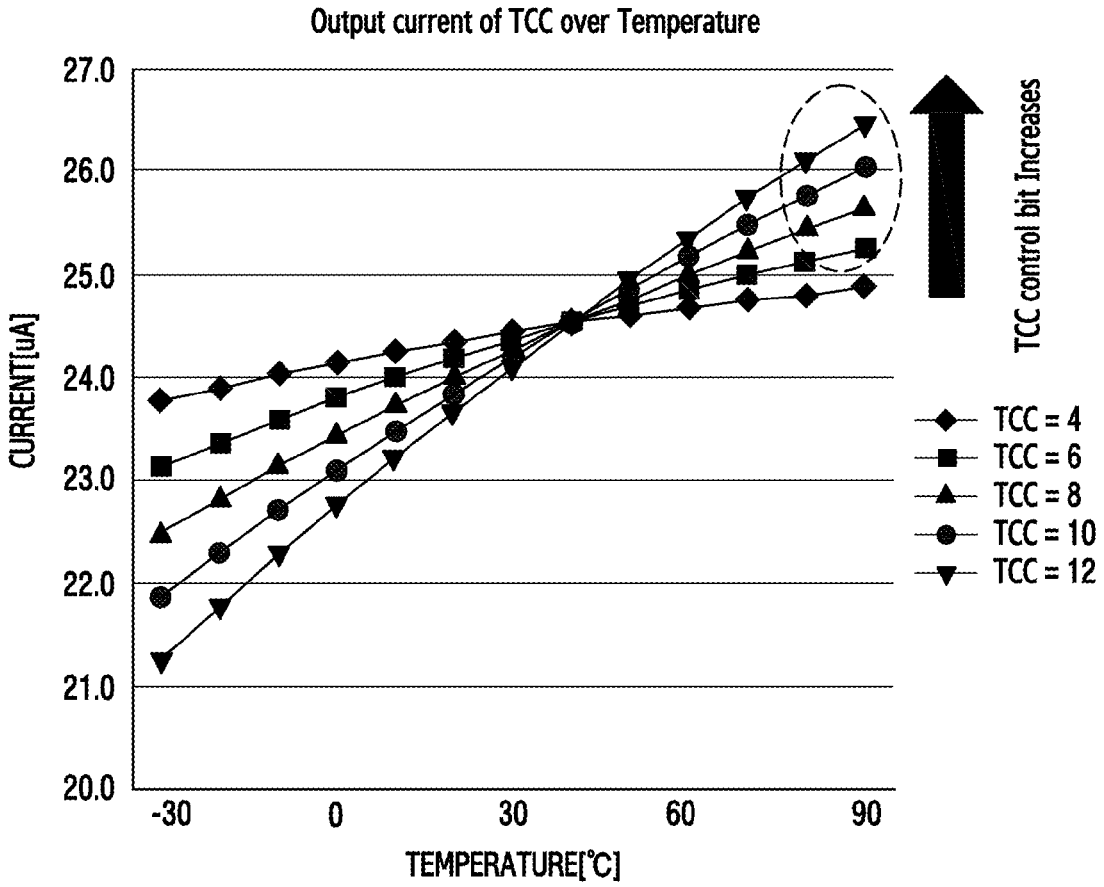
FIG. 13 illustrates a change in temperature coefficient according to a adjustment in a slope controller according to embodiments or the present disclosure.

FIG. 13 illustrates a change in temperature coefficient according to a adjustment in a slope controller according to embodiments of the present disclosure.

Referring to FIG. 13, an output current of a slope controller, through a weighted average of a BGR current and a PTAT current, illustrates that a slope of an output current of the slope controller increases with Temperature Coefficient Control bit (TCC) increase.

Figure 14:
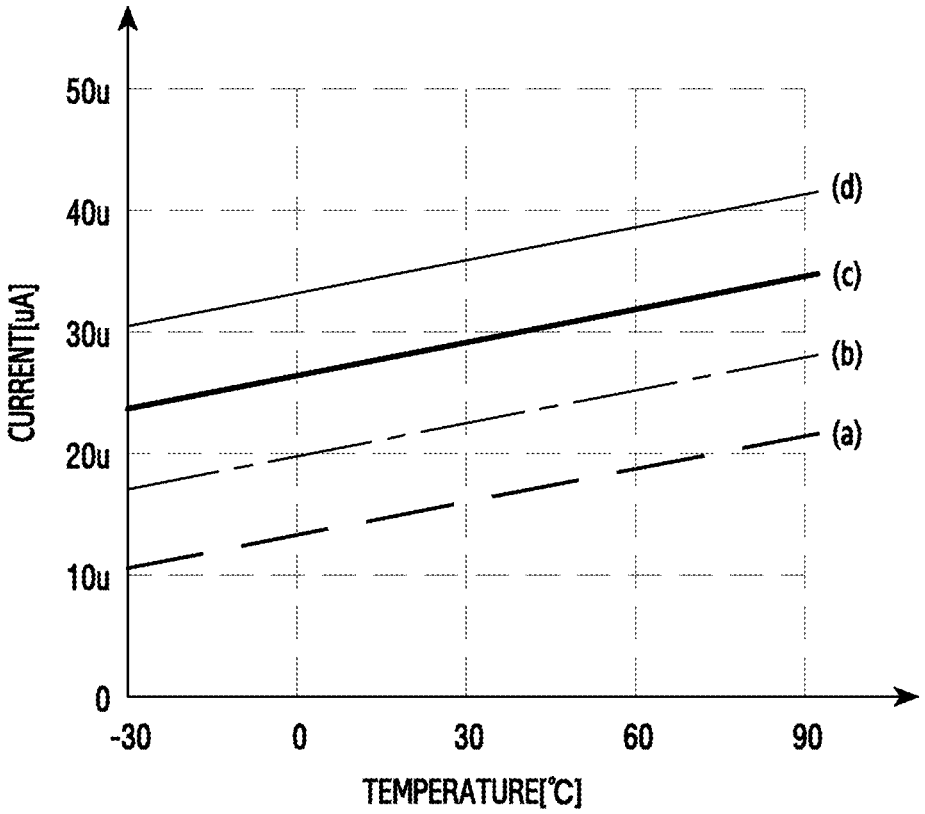
FIG. 14 illustrates an output current of a slope amplifier according to an initial current value in a slope amplifier according to embodiments of the present disclosure.

FIG. 14 illustrates an output current of a slope amplifier according to an initial current value in the slope amplifier according to embodiments of the present disclosure.

Referring to FIG. 14, as an initial current value increases as shown in (a), (b), (c) and (d), an output current of a slope amplifier increases. However, there is no change in a temperature coefficient or a slope.

Figure 15B:
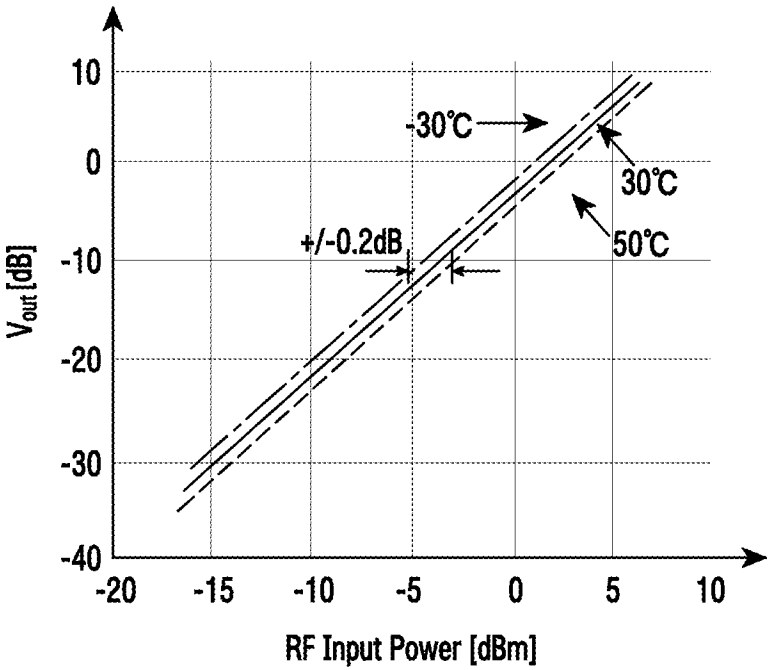
FIGS. 15A and 15B illustrate an output voltage fluctuation of a corresponding apparatus when a bias current is provided to the corresponding apparatus from a temperature compensation apparatus according to embodiments of the present disclosure.
Figure 15A:
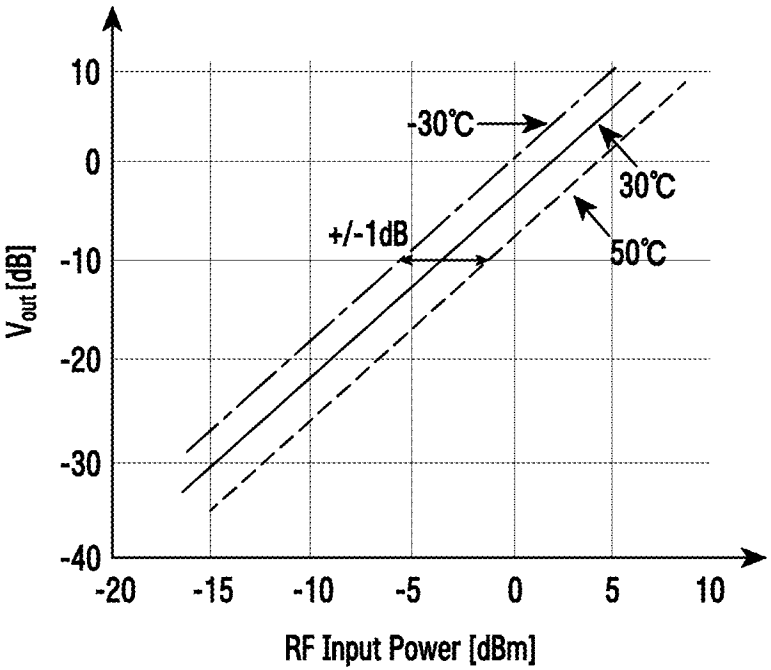

FIGS. 15A and 15B illustrate an output voltage fluctuation of a temperature compensation apparatus when a bias current is provided to a power detector from the corresponding apparatus according to embodiments of the present disclosure.

Referring FIGS. 15A and 15B, a simulation result of an output voltage fluctuation of square root circuits of the power detector illustrates that a fluctuation of the output voltage decreases according to temperature variation.

For example, as shown in FIG. 15A, a voltage fluctuation is +/−1 dB within a range of −30° C. to 50° C. when a TCDBL is not used, and as shown in FIG. 15B, a voltage fluctuation is +/−0.2 dB within a range of −30° C. to 50° C. when a TCDBL is used.

That is, a voltage fluctuation with using TCDBL is less than a voltage fluctuation without using TCDBL.

Embodiments of the present disclosure provide a communication device including a power detector that detects a transmission power of the communication device and a temperature compensator that supplies a bias to the power detector, wherein the temperature compensator comprises a reference signal generator that supplies at least one of a first current which is constant regardless of temperature variation and a second current which is proportional to temperature variation, a slope amplifier that determines a first output current having a second temperature coefficient which is a multiple of a first temperature coefficient of the second current, based on the first current and the second current, and a slope controller that determines a second output current having a third temperature coefficient, using a weighted average of the first current and the second current.

The slope amplifier includes at least one TCDBL that increases a size of the second current by n times and increases a size of the first current n−1 times, and then reduces the second current, which has been increased n times, by the size of the first current, which has been increased n−1 times, and generates the first output current.

The slope controller increases the first current by a and increases the second current by 1−α, and then adds the first current to the second current.

The communication device further includes a bias distributor that supplies at least one bias current to at least one other apparatus, using at least one of the first output current and the second output current.

The apparatus and communication device herein may be embodied as a chip set, and may be embodied in a terminal.

Methods stated in claims and/or specifications according to embodiments may also be implemented by hardware, software, or a combination of hardware and software.

In the implementation of software, a computer-readable storage medium for storing one or more programs (software modules) may be provided. The one or more programs stored in the computer-readable storage medium may be configured for execution by one or more processors within the electronic device. The at least one program includes instructions that cause the electronic device to perform the methods according to embodiments of the present disclosure as defined by the appended claims and/or disclosed herein.

The programs (software modules or software) may be stored in non-volatile memories including a random access memory and a flash memory, a Read Only Memory (ROM), an Electrically Erasable Programmable Read Only Memory (EEPROM), a magnetic disc storage device, a Compact Disc-ROM (CD-ROM), Digital Versatile Discs (DVDs), or other type optical storage devices, or a magnetic cassette. Alternatively, any combination of some or all of the may form a memory in which the program is stored. A plurality of such memories may be included in the electronic device.

The programs may be stored in an attachable storage device that is accessible through a communication network, such as the Internet, an Intranet, a Local Area Network (LAN), Wide LAN (WLAN), or Storage Area network (SAN), or a communication network configured with a combination thereof. The storage devices may be connected to an electronic device through an external port.

A separate storage device on the communication network may access a portable electronic device.

Although embodiments of the present disclosure have been described for illustrative purposes, those skilled in the art will appreciate that various modifications, additions and substitutions are possible, without departing from the scope and spirit of the present disclosure.

While the present disclosure has been particularly shown and described with reference to certain embodiments thereof, it will be understood by those skilled in the art that various changes in form and details may be made therein without departing from the spirit and scope of the present disclosure as defined by the appended claims and their equivalents.

What is claimed is:

1. An apparatus for compensating for a temperature, the apparatus comprising:

a reference signal generator configured to supply a first current which is constant regardless of a temperature variation and a second current which is proportional to temperature variation;

a slope amplifier configured to determine a first output current based on a difference between a multiple of the first current and a multiple of the second current;

a slope controller comprising at least one transistor, the slope controller configured to determine a second output current using a weighted average of the first current and the second current, wherein a weight value for the weighted average being related to a characteristic of the at least one transistor; and a bias distributor configured to supply a bias current to at least one other apparatus using at least one of the first output current and the second output current, wherein a first temperature coefficient of the bias current is greater than a second temperature coefficient of the second current, and wherein the first temperature coefficient and the second temperature coefficient is a rate of a temperature change with respect to the temperature variation.

2. The apparatus of claim 1, wherein the slope amplifier comprises at least one temperature coefficient double (TCDBL) configured to generate the first output current to be equal to (n×the second current)−((n−1)×the first current), where n is a number.

3. The apparatus of claim 2, wherein the slope amplifier further comprises a current mirror configured to copy the first output current.

4. The apparatus of claim 1, wherein the slope controller is further configured to increase the first current by a parameter α, which denotes the weight value, and increase the second current by 1−α, and adds the first current to the second current.

5. The apparatus of claim 1, wherein the slope controller comprises:

a first current mirror configured to mirror the first current which has been increased by a parameter α, which denotes the weight value:

a second current mirror configured to mirror the second current which has been increased by 1−α; and a third current mirror configured to mirror a current obtained by adding the first current which has been increased by α to the second current which has been increased by 1−α.

6. The apparatus of claim 1, wherein the bias distributor comprises:

a first input unit configured to mirror a first input current; and a first output unit configured to mirror the first output current and generate at least one third output current.

7. The apparatus of claim 1, wherein the bias distributer comprises:

a second input unit configured to mirror a second input current; and a second output unit configured to mirror the second output current and generate at least one fourth output current.

8. The apparatus of claim 1, wherein the reference signal generator comprises:

a band gap reference (BGR) configured to generate the first current; and a proportional to an absolute temperature (PTAT) circuit configured to generate the second current.

9. A method for compensating for a temperature in a device, the method comprising:

supplying a first current which is constant regardless of a temperature variation and a second current which is proportional to the temperature variation;

determining a first output current based on a difference between a multiple of the first current and a multiple of the second current;

determining a second output current using a weighted average of the first current and the second current, wherein a weight value for the weighted average being related to a characteristic of at least one transistor of the device; and supplying a bias current to at least one other device using at least one of the first output current and the second output current, wherein a first temperature coefficient of the bias current is greater than a second temperature coefficient of the second current, and wherein the first temperature coefficient and the second temperature coefficient is a rate of a temperature change with respect to the temperature variation.

10. The method of claim 9, wherein determining the first output current comprises:

generating the first output current to be equal to (n×the second current)−((n−1)×the first current), where n is a number.

11. The method of claim 9, wherein determining the second output current comprises:

increasing the first current by a parameter $\alpha$, which denotes the weight value; and increasing the second current by $1-\alpha$, and adding the first current to the second current.

12. The method of claim 9, wherein supplying the bias current comprises:

mirroring the first output current; and generating at least one third output current.

13. The method of claim 9, wherein supplying the bias current comprises:

mirroring the second output current; and generating at least one fourth output current.

14. A method by a temperature compensation apparatus, the method comprising:

generating a first current which is constant regardless of a temperature variation and a second current which is proportional to the temperature variation;

determining a first output current based on a difference between a multiple of the first current and a multiple of the second current;

determining a second output current using a weighted average of the first current and the second current, wherein a weight value for the weighted average is related to a characteristic of at least one transistor of the temperature compensation apparatus; and supplying a bias current to at least one other apparatus using at least one of the first output current and the second output current, wherein a first temperature coefficient of the bias current is greater than a second temperature coefficient of the second current, and wherein the first temperature coefficient and the second temperature coefficient is a rate of a temperature change with respect to the temperature variation.

15. The method of claim 14, wherein the first output current is equal to ((2×the second current)−the first current).

16. The method of claim 14, wherein the weighted average is determined by a sum of the first current multiplied by the weight value and the second reference signal multiplied by one minus the weight value.

17. The method of claim 14, further comprising:

supplying the bias current to the at least one other apparatus by distributing the first output current or the second output current to the at least one other apparatus, or by distributing a third output current obtained by multiplying the first output current and the second output current by parameters, to the at least one other apparatus.

18. The apparatus of claim 1, wherein the bias current is provided to the at least one other apparatus so that an output voltage of the at least one other apparatus is maintained regardless of the temperature variation.

19. The method of claim 9, wherein the bias current is provided to the at least one other device so that an output voltage of the at least one other device is maintained regardless of the temperature variation.

20. The method of claim 14, wherein the bias current is provided to the at least one other apparatus so that an output voltage of the at least one other apparatus is maintained regardless of the temperature variation.

* * * * *